US012570380B2

(12) United States Patent
Liu et al.

(10) Patent No.: US 12,570,380 B2
(45) Date of Patent: Mar. 10, 2026

(54) MARINE MODULAR INTELLIGENT ANTI-COLLISION DEVICE BASED ON AIRBAGS

(71) Applicant: JIANGSU UNIVERSITY OF SCIENCE AND TECHNOLOGY, Zhenjiang (CN)

(72) Inventors: Kun Liu, Zhenjiang (CN); Jiaxia Wang, Zhenjiang (CN); Tongqiang Yu, Zhenjiang (CN); Yue Lu, Zhenjiang (CN); Zhengyao Wang, Zhenjiang (CN)

(73) Assignee: JIANGSU UNIVERSITY OF SCIENCE AND TECHNOLOGY, Zhenjiang (CN)

( * ) Notice: Subject to any disclaimer, the term of this patent is extended or adjusted under 35 U.S.C. 154(b) by 478 days.

(21) Appl. No.: 18/230,704

(22) Filed: Aug. 7, 2023

(65) Prior Publication Data

US 2024/0002025 A1 Jan. 4, 2024

(51) Int. Cl.
*B63B 59/02* (2006.01)

(52) U.S. Cl.
CPC ..... *B63B 59/02* (2013.01); *B63B 2059/025* (2013.01)

(58) Field of Classification Search
CPC .... B63B 59/02; B63B 2059/025; Y02A 30/30
USPC ..... 280/28.2, 729, 734, 734.1
See application file for complete search history.

(56) References Cited

U.S. PATENT DOCUMENTS

2020/0374680 A1* 11/2020 D'Addetta ..... G06N 7/01
2023/0158993 A1* 5/2023 Nagasawa ..... B60R 21/0136 280/730.2

* cited by examiner

*Primary Examiner* — George C Jin
*Assistant Examiner* — Johnny H Hoang
(74) *Attorney, Agent, or Firm* — CBM PATENT CONSULTING, LLC

(57) ABSTRACT

A plurality of modules are arranged on the broadside of a ship, each module includes a housing, and the housing is provided with a composite gas supply assembly, a composite airbag assembly, an intelligent control assembly, and a mechanical transmission assembly; the intelligent control assembly is configured for predicting the impact energy and a collision angle of a collision object, sending an inflation instruction to the composite gas supply assembly, inflating a large airbag to a proper air pressure, inflating a small airbag to a rated air pressure, and sending an angle adjustment instruction to the mechanical transmission assembly to adjust the collision angle of the small airbag; the large airbag is matched with the small airbag to fully absorb a collision force vertically acting on the surface of a hull.

17 Claims, 8 Drawing Sheets

MARINE MODULAR INTELLIGENT ANTI-COLLISION DEVICE BASED ON AIRBAGS

CROSS-REFERENCE TO RELATED APPLICATIONS

This application claims priority to Chinese Patent Application Ser. No. CN2022109672687 filed on 12 Aug. 2022.

TECHNICAL FIELD

The present invention belongs to the technical field of ships, and particularly relates to a marine modular intelligent anti-collision device based on airbags.

BACKGROUND ART

At present, with the continuous development and utilization of marine resources, remarkable achievements are made in resource exploitation and development of fishery, transportation, and tourism industries. As an important transportation carrier, the ship industry is also booming, and ships of high economic value such as luxury yachts, high-standard fishing ships, and special scientific research ships are also emerging. However, due to various factors such as bad sea conditions and human negligence, the ships of high economic value are often involved in collision accidents in coastal areas, inland rivers, ports, and other areas. If an accident occurs to a ship of high economic value, in addition to huge economic and property losses, an unimaginable damage to the lives and properties of relevant personnel will be caused. In China, ships of high economic value are continuously improved, but the protective equipment for ships still needs to be continuously upgraded to meet needs. Most of the existing external devices used for marine anti-collision are waste tires or rubber balls exposed on the outer side. However, waste tires not only affect the appearance, but also have limited protection capability. The rubber balls are generally used at the time of docking or berthing, but cannot be used in time in case of an emergency; and because the balls are suspended on the broadside and floated in water, they cannot accurately and continuously protect a specific area of the ship. In addition, the existing marine inflatable protection devices mostly adopt a single inflatable closed capsule, which absorbs energy only through compressive deformation when dealing with a collision force, and even slips or is misplaced in case of collision with a certain angle. To sum up, an intelligent airbag protection device capable to protect high-value ships under the condition of a limited volume is urgently needed. The intelligent airbag protection device may be installed in various important structural areas, and is capable to work independently or work with other devices for joint protection in a clustered manner. In a collision risk scenario, the device is capable to quickly calculate the impact energy to be suffered, as well as the collision angle and contact surface shape of a protection area, so as to achieve effective protection through intelligent control.

SUMMARY

An objective of the present invention is to solve the above problems and provide a marine modular intelligent anti-collision device based on airbags, which is suitable for high-value ships and high-value marine engineering equipment.

The objective of the present invention is achieved by means of the following technical solution: a marine modular intelligent anti-collision device based on airbags, which is applied to the field of ships; a plurality of modules are arranged on the broadside of a ship, each module includes a housing, and the housing is provided with a composite gas supply assembly, a composite airbag assembly, an intelligent control assembly, and a mechanical transmission assembly; the composite airbag assembly includes a large airbag and small airbags; the composite gas supply assembly supplies gas for the composite airbag assembly; the composite airbag assembly is configured to resist the external collision of a hull and protect the structure of the hull; the mechanical transmission assembly is configured to adjust the collision angle of the small airbag; and the intelligent control assembly is configured for predicting the impact energy and a collision angle of a collision object, sending an inflation instruction to the composite gas supply assembly, inflating a large airbag to a proper air pressure, inflating a small airbag to a rated air pressure, and sending an angle adjustment instruction to the mechanical transmission assembly to adjust the collision angle of the small airbag.

Preferably, the large airbag is in the shape of a spheroid, and the surface of the large airbag is provided with vent holes arranged in an annular manner; the vent holes are configured to fully buffer the energy release; the two small airbags are located in the large airbag; and the small airbags are in the shape of water droplets.

Each of the airbags is made of a watertight and airtight material, and is capable to withstand sufficient external impact without damage and air leakage. Since the small airbag is in the shape of a water drop, one end thereof is large and the other end thereof is small, and the air inlet of the small airbag is located on the side close to the broadside of the hull. Therefore, the internal small airbag can be rotated and adjusted to an optimal collision angle through the mechanical transmission assembly, so as to better disperse collision energy. A component force parallel to the surface of the hull is better dispersed along a horizontal direction, so that part of the energy that destroys the hull structure can be transferred and disappear in the form of surface slip. By use of two small airbags, it is ensured that at a given collision angle, energy transfer is balanced and stable, so that the damage of a single small airbag due to a small working area at the bottom of the hull and the unstable angle of the airbag can be avoided.

Preferably, the composite gas supply assembly is located above one side of the housing; the composite gas supply assembly includes high-pressure steel cylinders, a gas transmission channel A, a gas transmission channel B, a gas generator, and an electric airtight valve; the gas generator and the electric airtight valve are all electrically connected with the intelligent control assembly; the high-pressure steel cylinder is connected with the electric airtight valve; the electric airtight valve is connected with the large airbag through the gas transmission channel A; and the gas generator is connected with the small airbag through the gas transmission channel B.

There are two high-pressure steel cylinders; the electric airtight valve is provided with two airtight interfaces, where one airtight interface is provided with a Y-shaped three-way pipe A, and the other airtight interface is connected to the gas transmission channel A; the electric airtight valve is connected to two high-pressure steel cylinders through a Y-shaped three-way pipe; the gas generator is provided with a Y-shaped three-way pipe B; and the gas generator is connected to a small airbag through a Y-shaped three-way pipe B arranged therein. Two gas supply modes are configured to control a switch of the electric airtight valve according to the feedback information from the intelligent control assembly. The high-pressure steel cylinder provides the optimum air pressure for the large airbag, and the gas generator provides the rated air pressure for the small airbag to fully absorb or transfer the collision energy.

Preferably, a circular support frame is arranged at a point near the air inlet of the large airbag, to stretch the large airbag so as to arrange a small airbag inside it; the outer periphery of the large airbag is respectively provided with light bars that are connected with the housing; and the housing is provided with a storage bin, and the airbag not inflated is folded in the storage bin. The outer surface of the large airbag is provided with four wrapping stripes, and the light bars penetrate the wrapping stripes and are fixedly connected with the housing. When the large airbag is working, the light bars are capable to play a role of fixing to ensure that the large airbag will not be misplaced but remains balanced and stable when it encounters a collision, because the energy of collision is fully absorbed; and the storage bin takes up little space.

Preferably, the intelligent control assembly is located below one side of the housing; the intelligent control assembly includes an image acquisition sensor, an infrared range finder, a central processing unit, and a plurality of wires; the wires are respectively electrically connected to the composite gas supply assembly and the mechanical transmission assembly; the image acquisition sensor is configured to collect and identify potential collision objects in surrounding areas and the sea conditions near the waters where the ship is located; the infrared range finder assists an image acquisition sensor to send the environmental information and obstacle information to the central processing unit, then the central processing unit preliminarily calculates the probability of any collision risk, and when the collision risk is confirmed, the central processing unit calculates the energy impact that the protection area is about to suffer, as well as the contact surface shape and collision angle of the collision object that the area is about to approach; the predicted impact energy is converted into an appropriate air pressure for the large airbag, and the collision contact surface shape and the collision angle are converted into the collision angle of the small airbag.

The information of the collision object such as the navigation direction, relative orientation, height difference, draft, relative speed, surface shape, etc. is acquired and processed to predict the position of contact between the protection area and the collision object, that is, the curvature of the contact surface of the collision object. And the value range of energy that the collision object brings to the ship is predicted and calculated. The intelligent control assembly converts such information into an optimum internal pressure of the external airbag and an optimum collision angle of the internal airbag. When the electric airtight valve in the composite gas supply assembly is opened, the high-pressure gas in the high-pressure steel cylinder is released to rapidly inflate the external spherical large airbag, and when the internal pressure of the airbag reaches the optimum pressure, the electric airtight valve is closed. Simultaneously, the gas generator ignites to inflate the inner drop-like airbag.

Preferably, the housing is provided with a base; when a transmission rack B drives gears, the base is capable to prevent the rack from being entangled in the airbag during movement; the base is provided with a small air outlet A, a small air outlet B, and a large air outlet, where the small air outlet A and the small air outlet B are rotatably connected with the housing; the large air outlet is located between the small air outlet A and the small air outlet B; the large airbag is connected to the composite gas supply assembly through the large air outlet, and the small airbags are respectively connected with the composite gas supply assembly through the small air outlet A and the small air outlet B.

Preferably, the mechanical transmission assembly includes a small motor, a gear A, a gear B, a gear C, a gear D, a transmission rack A, and a transmission rack B; the transmission rack A is vertically and slidably arranged in the housing and is capable to move up and down, and the transmission rack B is horizontally and slidably arranged in the housing and is capable to move horizontally; the transmission rack A and the transmission rack B are rotatably connected through the gear B; the small motor and the gear A are rotatably connected, the gear A and the gear B mesh with the transmission rack A respectively, and the gear B, the gear C, and the gear D mesh with the transmission rack B respectively; the gear A, the gear B, the gear C, and the gear D Both are rotatably connected with the housing; and the gear C is connected with the small air outlet A, and the gear D is connected with the small air outlet B.

Preferably, one side of the transmission rack A close to the broadside of the ship is provided with a plurality of roll balls A along its length direction, the housing is provided with a vertical chute, and the transmission rack A is slidably arranged in the vertical chute through the plurality of roll balls A; one side of the transmission rack B close to the broadside of the ship is provided with a plurality of roll balls B along its length direction, the housing is provided with a transverse chute, and the transmission rack B is slidably arranged in the transverse chute through the plurality of roll balls B.

Preferably, the gear A, the gear B, the gear C, and the gear D are connected to the housing through a rotating structure, the rotating structure includes a rotating shaft and a bearing, where the outer ring of the bearing is connected to the inner ring of the gear, one end of the rotating shaft is arranged in the inner ring of the bearing, the other end of the rotating shaft is connected to the housing, and a rotational connection between the gear and the housing is realized through the connection between the bearing and the rotating shaft.

The rotation of the small motor drives the gear A to rotate, and the gear A meshes with the transmission rack A, so that the transmission rack A moves up; since the transmission rack A meshes with the gear B, it drives the gear B to rotate, and at the same time, the gear B meshes with the transmission rack B, so that the transmission rack B moves to the right; because the gear C and the gear D both mesh with the transmission rack B, the small air outlet A and the small air outlet B are deflected, so that the small airbag is driven to rotate; similarly, when the motor reverses, the small airbag rotates in the opposite direction.

Preferably, one side of the housing close to the broadside of the ship is provided with a plurality of slats, one side of the slats close to the broadside of the ship is provided with strong magnetic stripes, each of the slats is connected by means of a hinge, and the housing is installed on the broadside of the ship by means of the strong magnetic stripes; a telescopic connecting rod is arranged between every two modules of the housing.

A bottom plate of a stripe structure is connected with the slats by means of the hinge, so that one side of the housing features a certain curvature change, and a combination with the strong magnetic stripes makes them closely fit the steel plate surface on the broadside of the ship with a certain curvature.

The present invention has the following beneficial effects: (1) according to the present invention, the intelligent control assembly controls the electric airtight valve to inflate the large airbag to the optimum air pressure, and the large airbag is provided with the vent holes, so that it is capable to absorb energy through compression, but also can release a large amount of energy through the vent holes; the small airbag has a drop-like structure, and the small airbag is adjusted to a suitable angle through the mechanical transmission assembly, resulting in that a tangential force at a certain angle can be effectively dealt with, the device is prevented from slipping, it is ensured that the device is not misplaced, and effective airbag protection is enabled for the protection area, so as to solve the problem that the existing protective devices are likely to slip or be misplaced in case of any collisions with a certain angle, because a single inflatable closed capsule is usually adopted, which only absorbs energy through compression and deformation when dealing with a collision force; a combination of the outer large airbag and the inner small airbag enables to fully absorb the component collision force perpendicularly acting on the hull surface, and then the component collision force parallel to the hull surface is transferred through the special angle combination of the small airbag inside each module, which is capable to achieve accurate and effective protection against collisions; and the device is different from traditional anti-collision devices featuring fixed areas, constant protection angles, and limited protection capabilities.

(2) If the device of the present invention is arranged on the broadside of a ship, the whole device is closely attached to the broadside of the ship when there is no danger, and the airbags are folded and placed in the housing, occupying a small area and volume; the exterior of the device and the hull installation area set to be consistent in color, thus having a certain degree of concealment; at the same time, the telescopic connecting rod can be adjusted to splice each housing module according to the needs of the broadside of the ship, so that the overall adaptability thereof is strong.

(3) The back of the housing of the present invention is arranged to be stripe-shaped, the stripes are connected by the hinges, and strong magnetic stripes are combined, so that the back of the housing is capable to change at a certain curvature and closely fit the important area surfaces of ships or marine engineering equipment with a certain linearity that need to be protected.

In the figures: 1. infrared range finder, 2. central processing unit, 3. high-pressure steel cylinder, 4. gas generator, 5. large air outlet, 6*a*. small air outlet A, 6*b*. small air outlet B, 7. gear B, 8. strong magnetic stripe, 9. hinge, 10. large airbag, 11. small airbag, 12. vent hole, 13. connecting hole, 14. storage bin, 15*a*. gas transmission channel A, 15*b*. gas transmission channel B, 16. light bar, 17. small motor, 18*a*. transmission rack A, 18*b*. transmission rack B, 19. gear A, 20. gear C, 21. gear D, 22. electric airtight valve, 23. base, 24. housing, 25. telescopic connecting rod, 26*a*. roll ball A, 26*b*. roll ball B, 27. support frame, and 28. bracket.

DETAILED DESCRIPTION OF THE EMBODIMENTS

In order to make the objectives, technical solutions and advantages of the embodiments of the present invention clearer, the technical solutions in the embodiments of the present invention will be clearly and completely described below in combination with the accompanying drawings in the embodiments of the present invention. Apparently, the embodiments described are merely some rather than all of the embodiments of the present invention. On the basis of the embodiments in the present invention, all other embodiments acquired by those of ordinary skill in the art without making creative efforts fall within the scope of protection of the present invention.

Figure 1:
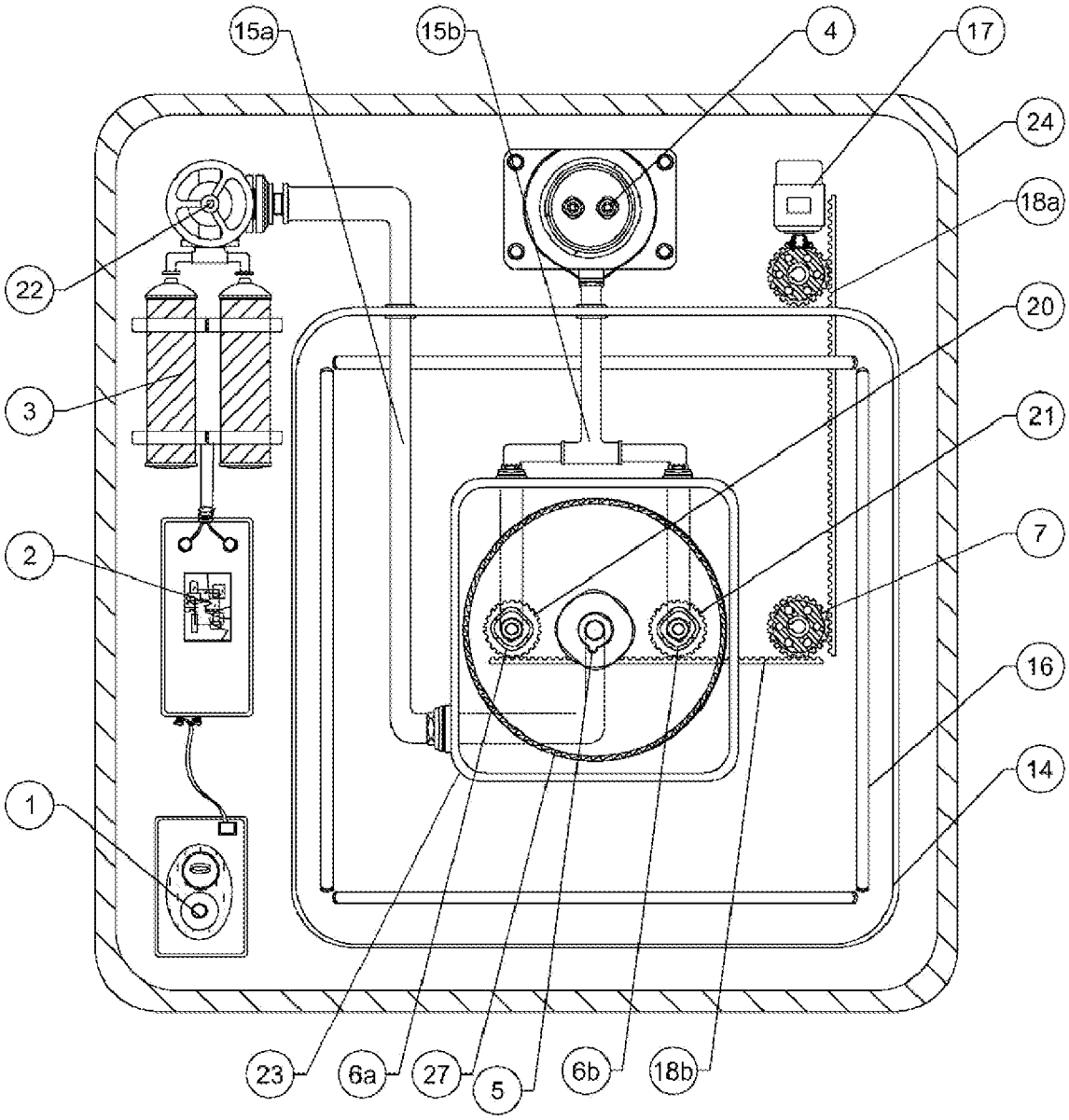
FIG. 1 is a front view of an overall structure of the present invention without an airbag.
Figure 2:
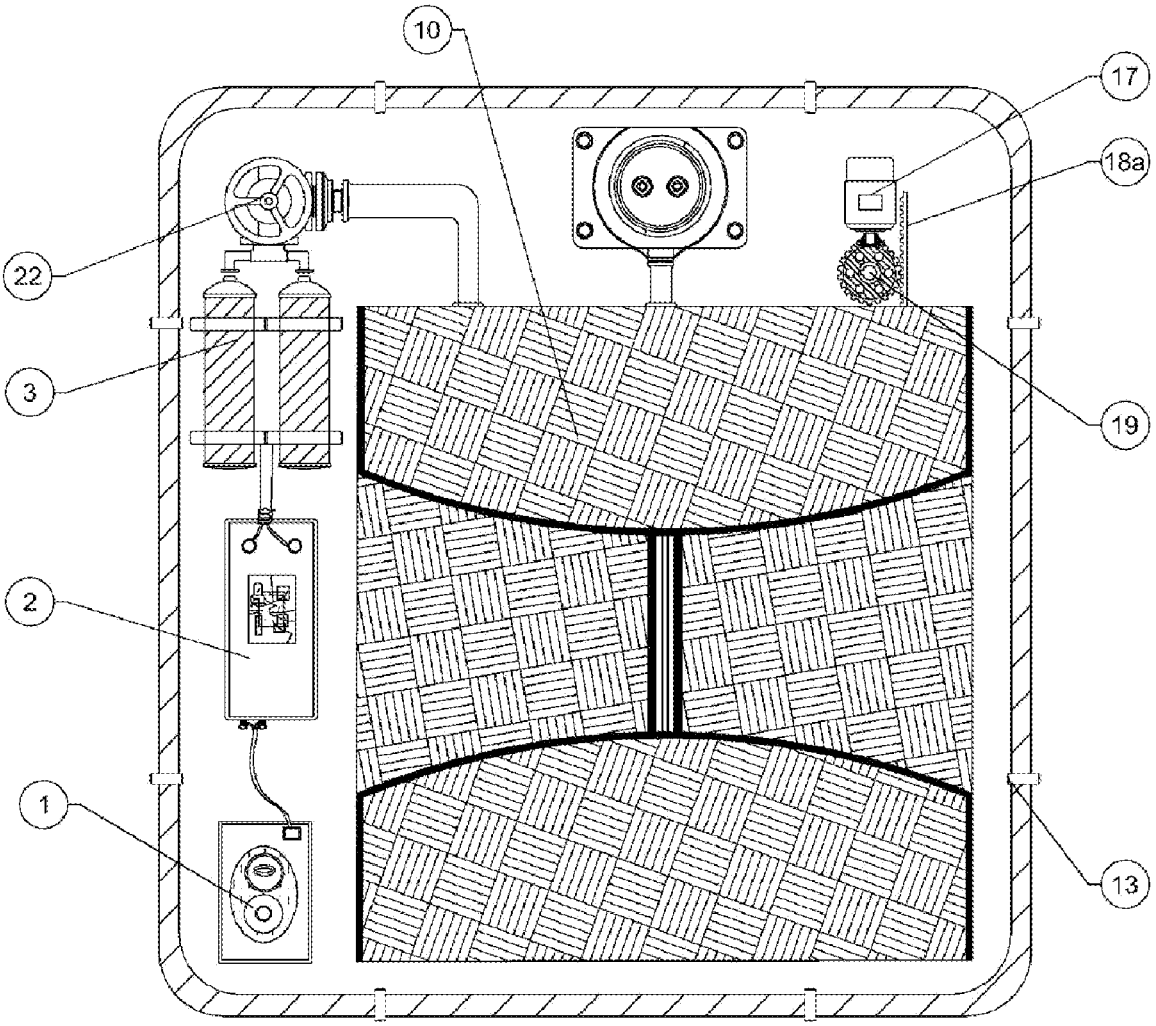
FIG. 2 is a front view of the overall structure of the present invention with an airbag.
Figure 3:
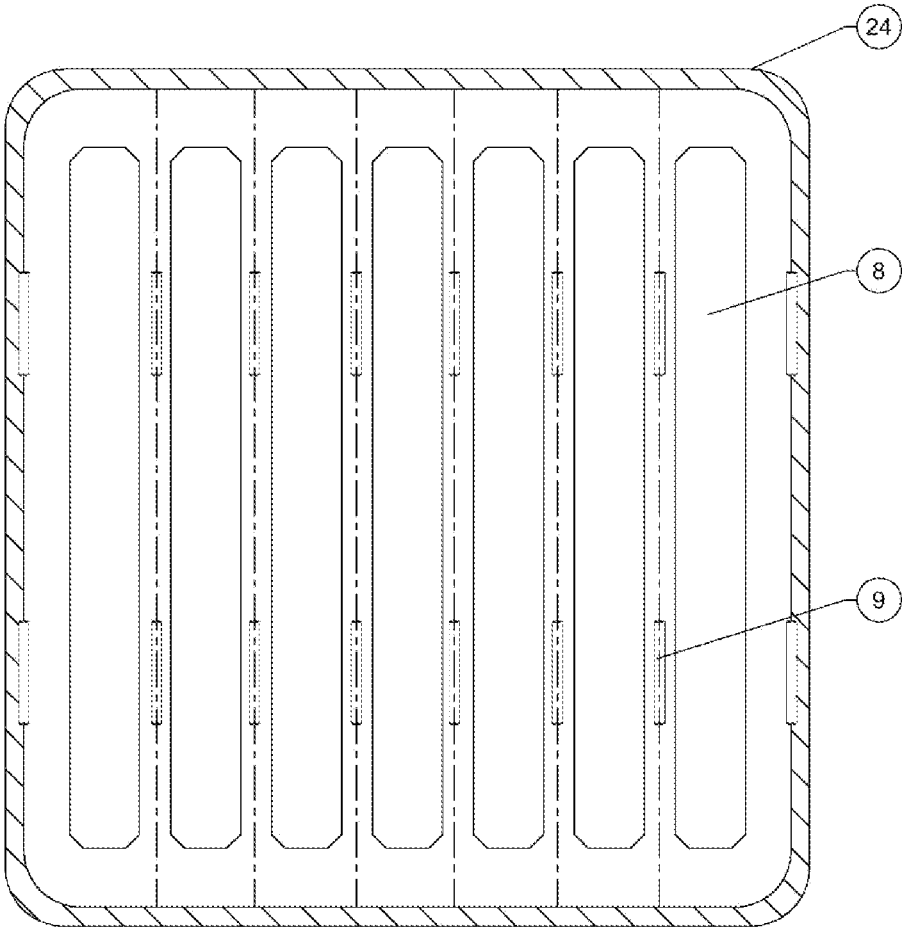
FIG. 3 is a rear view of a device of the present invention.
Figure 6:
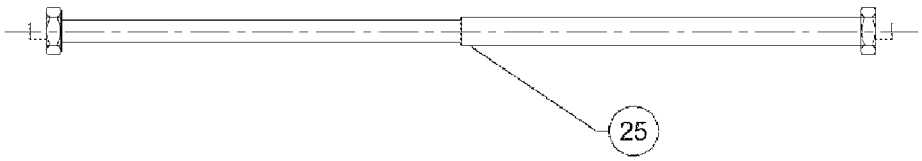
FIG. 6 is a schematic diagram of a structure of a telescopic connecting rod of the present invention.
Figure 11:
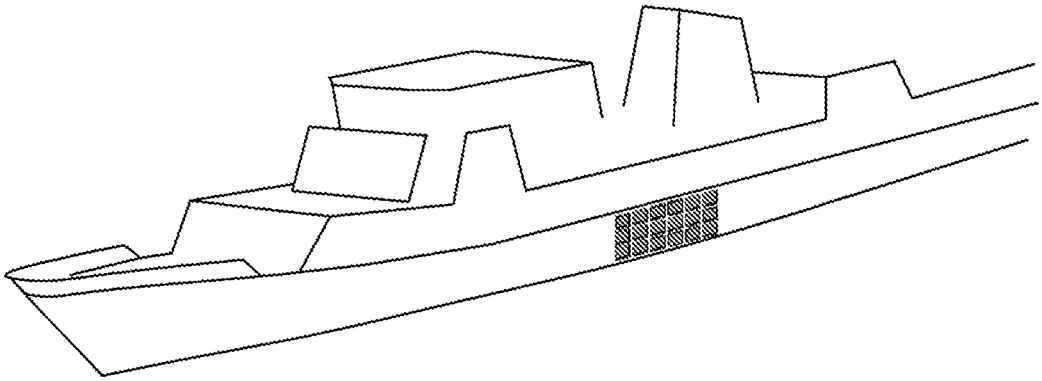
FIG. 11 is a schematic diagram of the structure of the device installed on a broadside of a ship.

As shown in FIGS. 1, 2, and 11, a marine modular intelligent anti-collision device based on airbags, which is applied to the field of ships, and a plurality of modules are arranged on the broadside of a ship; as shown in FIGS. 3 and 6, one side of a housing 24 close to the broadside of the ship is provided with a plurality of slats, one side of the slats close to the broadside of the ship is provided with strong magnetic stripes 8, each of the slats is connected by means of a hinge 9, the slats on both sides are also connected to the housing by means of the hinge, and the housing 24 is installed on the broadside of the ship by means of the strong magnetic stripes 8; the side of the housing 24 is provided with a connecting hole 13, a telescopic connecting rod 25 is arranged between every two modules of the housing 24, and the two ends of the telescopic connecting rod 25 are fixed in the connecting hole 13; before each module of the housing is installed in a clustering manner, the length of the telescopic connecting rod 25 is first adjusted according to the needs of the ship broadside protection area, and then each module of the housing is connected by means of a telescopic connecting rod.

The module includes a housing 24, and housing can be covered by thin-gauge skin, thus having a certain concealment; an intelligent control assembly is arranged on the lower left side of the housing 24, a composite gas supply assembly is arranged on the upper left side of the housing 24, a mechanical transmission assembly is arranged on the right side of the housing 24, a composite airbag assembly occupies the largest space in the housing 24, and the composite airbag assembly is arranged on the bottom right inside the housing 24; the composite airbag assembly includes a large airbag 10 and small airbags 11; the composite gas supply assembly supplies gas for the composite airbag assembly; the composite airbag assembly is configured to resist the external collision of a hull and protect the structure of the hull; the mechanical transmission assembly is configured to adjust the collision angle of the small airbag 11; and the intelligent control assembly is configured for predicting the impact energy and a collision angle of a collision object, sending an inflation instruction to the composite gas supply assembly, inflating a large airbag 10 to a proper air pressure, inflating a small airbag 11 to a rated air pressure, and sending an angle adjustment instruction to the mechanical transmission assembly to adjust the collision angle of the small airbag 11.

The intelligent control assembly includes an image acquisition sensor, an infrared range finder 1, a central processing unit 2, and a plurality of wires; the wires are respectively electrically connected to an electric airtight valve 22 in the composite gas supply assembly, a gas generator 4, and a small motor 17 in the mechanical transmission assembly; the image acquisition sensor is configured to collect and identify potential collision objects in surrounding areas and the sea conditions near the waters where the ship is located; the infrared range finder 1 assists an image acquisition sensor to send the environmental information and obstacle information to the central processing unit 2, then the central processing unit 2 preliminarily calculates the probability of any collision risk, and when the collision risk is confirmed, the central processing unit calculates the energy impact that the protection area is about to suffer, as well as the contact surface shape and collision angle of the collision object that the area is about to approach; the predicted impact energy is converted into an appropriate air pressure for the large airbag 10, and the collision contact surface shape and the collision angle are converted into the appropriate collision angle of the small airbag 11.

The composite gas supply assembly includes high-pressure steel cylinders 3, a gas transmission channel A 15*a*, a gas transmission channel B 15*b*, a gas generator 4, and an electric airtight valve 22; the gas generator 4 and the electric airtight valve 22 are all electrically connected with the intelligent control assembly; two steel cylinder brackets are arranged in the housing 24, the high-pressure steel cylinder 3 is installed after a liner is installed in each steel cylinder bracket, and the liner is capable to reduce the shaking of the high-pressure steel cylinder 3 and improve the gas storage safety of the high-pressure steel cylinder 3; the electric airtight valve 22 is provided with two airtight interfaces, where one airtight interface is provided with a Y-shaped three-way pipe A, and the other airtight interface is connected to the gas transmission channel A 15*a*; the gas transmission channel A 15*a* is connected to the large airbag 10 through a large air outlet 5; the electric airtight valve 22 is connected to two high-pressure steel cylinders 3 through a Y-shaped three-way pipe A; the gas generator 4 is provided with a Y-shaped three-way pipe B; and the gas generator 4 is connected to a small airbag 11 through a Y-shaped three-way pipe B arranged therein. Airtight rubber gaskets are arranged between the joints of the channels in the device for sealing. Two gas supply modes are configured to control a switch of the electric airtight valve 22 according to the feedback information from the intelligent control assembly. The high-pressure steel cylinder 3 provides the optimum air pressure for the large airbag 10, and the gas generator 4 provides the rated air pressure for the small airbag 11 to fully absorb the collision energy. The external large airbag is mainly used for energy release, is capable to deal with various levels of impact energy, and the protection effects of different internal pressures are different. Therefore, the internal pressure of the external large airbag needs to be controlled to deal with different levels of impact energy. For small airbags without vent holes, it is only necessary to reach a rated pressure.

Figure 8:
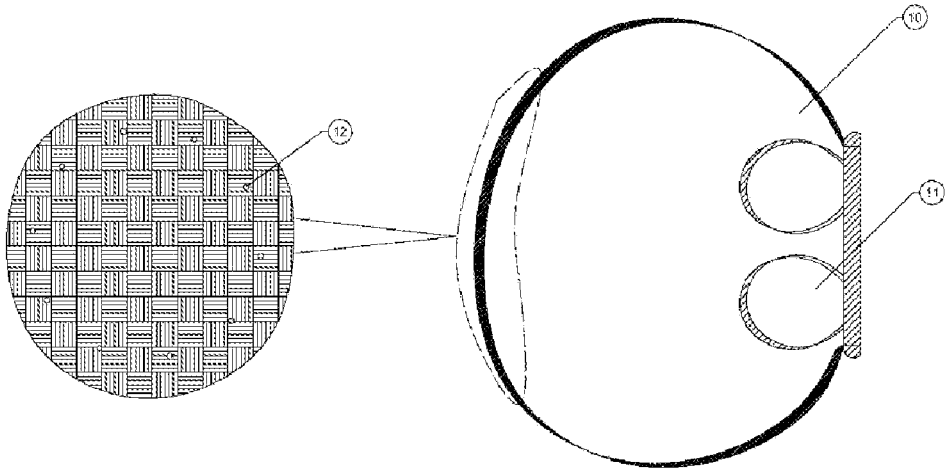
FIG. 8 is a top view of a composite airbag assembly after inflation.
Figure 9:
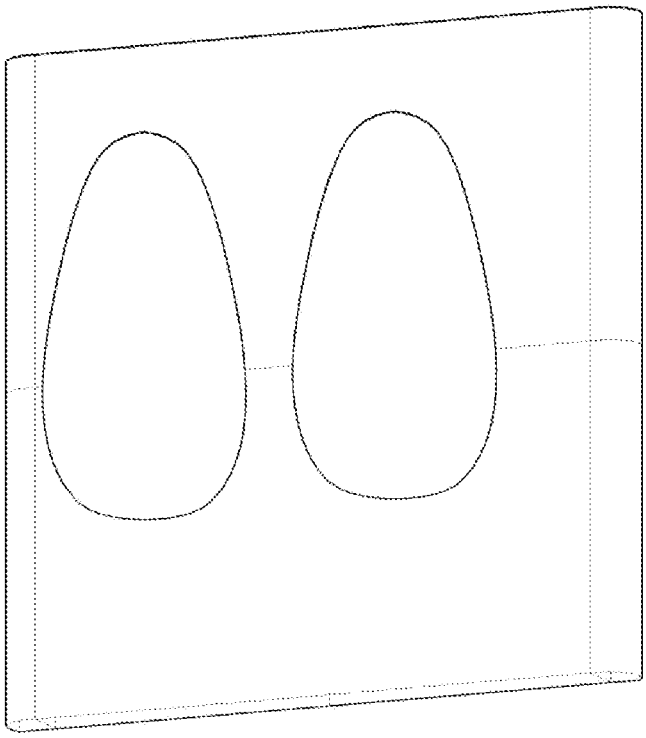
FIG. 9 is a front view of a small airbag after inflation.
Figure 10:
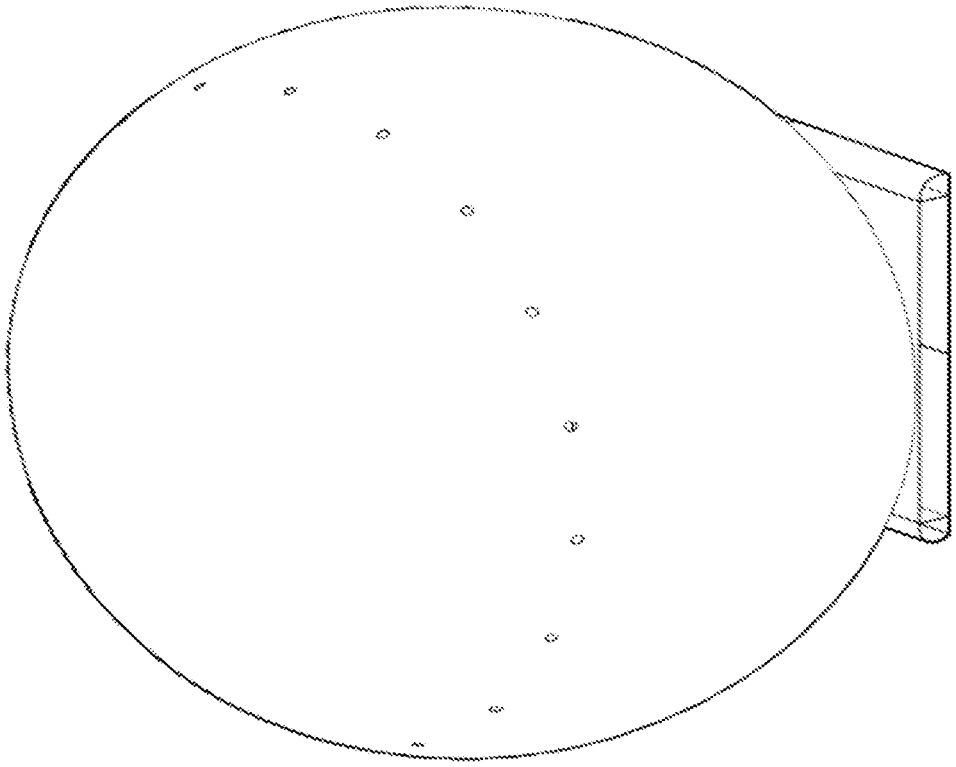
FIG. 10 is a front view of a large airbag after inflation.

A storage bin 14 is arranged in the housing, and the airbag not unfolded is folded and placed in the storage bin, taking up little space. As shown in FIG. 10, the large airbag 10 is in the shape of a spheroid, and the surface of the large airbag 10 is provided with vent holes 12 arranged in an annular manner; the vent holes 12 are configured to fully buffer the energy release; the large airbag 10 is provided with the vent holes, so that it is capable to absorb energy through compression, but also can release a large amount of energy through the vent holes; a circular support frame 27 is arranged at a point near the air outlet of the large airbag 10 to stretch the large airbag at a position near the bottom, and two small airbags 11 are symmetrically arranged inside the large airbag; in addition, wrapping stripes are arranged around the outer surface of the large airbag, light bars 16 are arranged inside the wrapping stripes, the two ends of the vertical light bars are fixedly connected with the housing, there exist gaps in other spaces, two points in the middle of the horizontal light bars are fixedly connected with the housing, and there exist gaps between other parts and the housing; the light bars are light aluminum alloy rods; when the large airbag is unfolded and encounters the collision, the light bars are capable to maintain the stability of the large airbag and prevent the occurrence of deviation or offset. As shown in FIGS. 8 and 9, two small airbags 11 are symmetrically arranged in the large airbag 10; the small airbag 11 is in the shape of water droplets, one end thereof is large and the other end thereof is small, an inflation inlet is located behind the small airbag, a square annular bracket 28 and square annular wrapping stripes are arranged at the periphery of the small airbag near an inflation inlet, the square annular wrapping stripes are configured to wrap the square annular bracket 28, and the square annular bracket 28 is connected with a gear C 20 and a gear D 21; in this way, the collision angle of the small airbag can be adjusted, and a component force parallel to the surface of the hull is better dispersed along a horizontal direction, so that part of the energy that destroys the hull structure can be transferred and disappear in the form of surface slip. The use of two small airbags ensures balance and stability during sliding, so that the damage of a small airbag caused by instability of working in a small acting area where the bottom of the small airbag is fixed can be avoided. The inflation inlets of the airbag are all sealed. Each of the airbags is made of an air-proof and airtight material, and is capable to withstand sufficient external impact without damage and air leakage.

Figure 7:
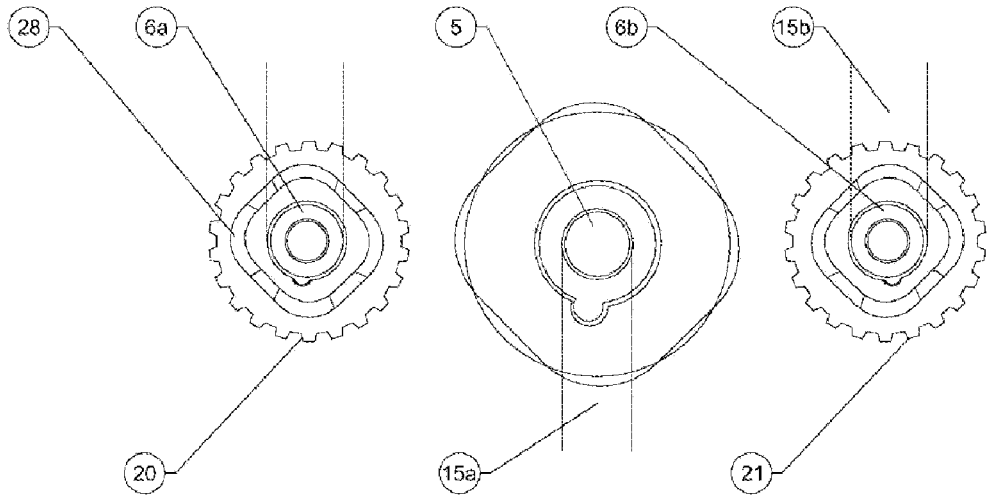
FIG. 7 is an enlarged schematic diagram of a large air outlet and a small air outlet in the present invention.

As shown in FIG. 7, the housing 24 is provided with a base 23; the base 23 is provided with a small air outlet A 6*a*, a small air outlet B 6*b*, and a large air outlet 5, where the small air outlet A 6*a* and the small air outlet B 6*b* are rotatably connected with the housing 24, and the large air outlet 5 is fixedly connected with the housing 24; the small air outlet A 6*a* is fixedly connected with the gear C through the bracket 28, and the small air outlet B 6*b* is fixedly connected with the gear D through the bracket 28; the large air outlet 5 is located between the small air outlet A 6*a* and the small air outlet B 6*b*; the large airbag 10 is connected to the gas transmission channel A 15*a* of the composite gas supply assembly through the large air outlet 5, and the small airbags 11 are respectively connected with the gas transmission channel B 15*b* of the composite gas supply assembly through the small air outlet A 6*a* and the small air outlet B 6*b*.

The mechanical transmission assembly includes a small motor 17, a gear A 19, a gear B 7, a gear C 20, a gear D 21, a transmission rack A 18*a*, and a transmission rack B 18*b*; the transmission rack A 18*a* is vertically and slidably arranged in the housing 24 and is capable to move up and down, and the transmission rack B 18*b* is horizontally and slidably arranged in the housing 24 and is capable to move horizontally; the transmission rack A 18*a* and the transmission rack B 18*b* are rotatably connected through the gear B 7; the small motor 17 and the gear A 19 are rotatably connected, the gear A 19 and the gear B 7 mesh with the transmission rack A 18*a* respectively, and the gear B 7, the gear C 20, and the gear D 21 mesh with the transmission rack B 18*b* respectively; the gear A 19, the gear B 7, the gear C 20, and the gear D 21 all are rotatably connected with the housing 24; and the gear C 20 is connected with the small air outlet A 6*a*, and the gear D 21 is connected with the small air outlet B 6*b*.

Figure 4:
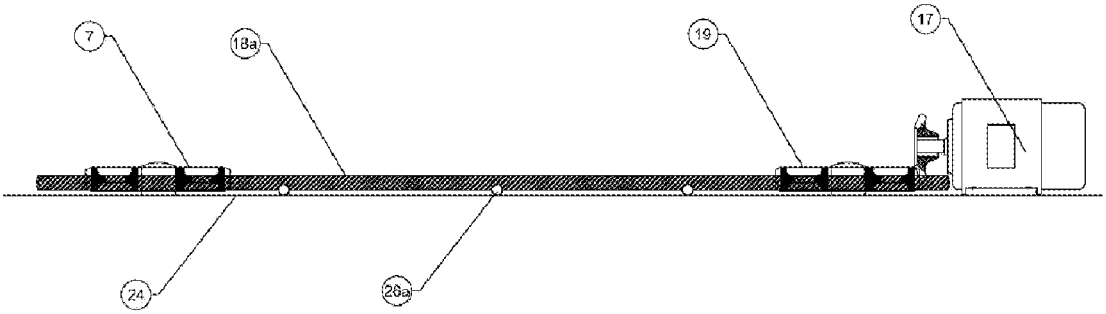
FIG. 4 is a left view of the device of the present invention.
Figure 5:
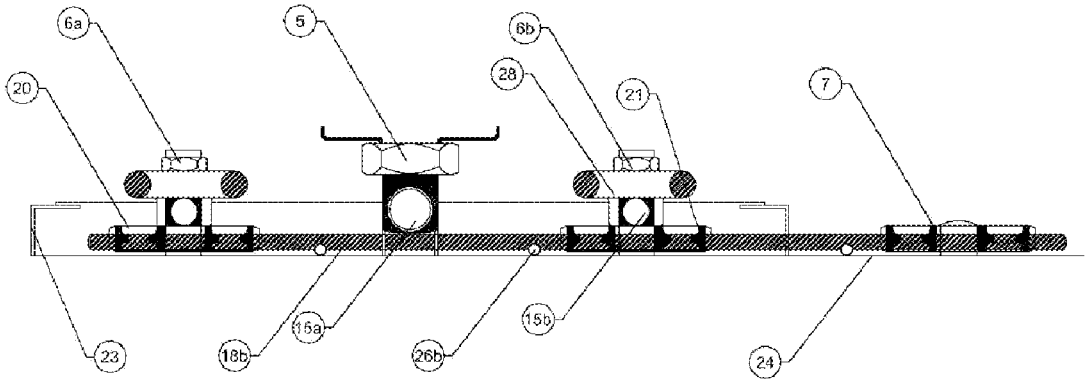
FIG. 5 is a bottom view of the device of the present invention.

As shown in FIGS. 4 and 5, the small motor 17 is installed in the housing 24, the output shaft of the small motor 17 is provided with a gear, the gear is meshed with the gear A 19 to drive the gear A 19 to rotate; one side of the transmission rack A 18*a* close to the broadside of the ship is provided with a plurality of roll balls A 26*a* along its length direction, the housing 24 is provided with a vertical chute, and the transmission rack A 18*a* is slidably arranged in the vertical chute through the plurality of roll balls A 26*a*; one side of the transmission rack B 18*b* close to the broadside of the ship is provided with a plurality of roll balls B 26*b* along its length direction, the housing 24 is provided with a transverse chute, and the transmission rack B 18*b* is slidably arranged in the transverse chute through the plurality of roll balls B 26*b*. The inner ring of the gear A 19 is connected to the outer ring of the bearing, one end of the rotating shaft is arranged in the inner ring of the bearing, the other end of the rotating shaft is connected to the housing 24; the inner ring of the gear B 7 is connected to the outer ring of the bearing, one end of the rotating shaft is arranged in the inner ring of the bearing, and the other end of the rotating shaft is connected to the housing 24; the gear C20 is arranged under the small air outlet A 6*a*, the small air outlet A 6*a* is fixedly connected with the gear C 20 through the bracket 28, the inner ring of the gear C 20 is connected with the bearing, one end of the rotating shaft is arranged in the inner ring of the bearing, and the other end of the rotating shaft is connected to the housing 24; the gear D 21 is arranged below the small air outlet B 6*b*, the small air outlet B 6*b* is fixedly connected to the gear D 21 through the bracket 28, the inner ring of the gear D 21 is connected to the outer ring of the bearing, one end of the rotating shaft is arranged in the inner ring of the bearing, and the other end of the rotating shaft is connected to the housing 24.

Figure 12:
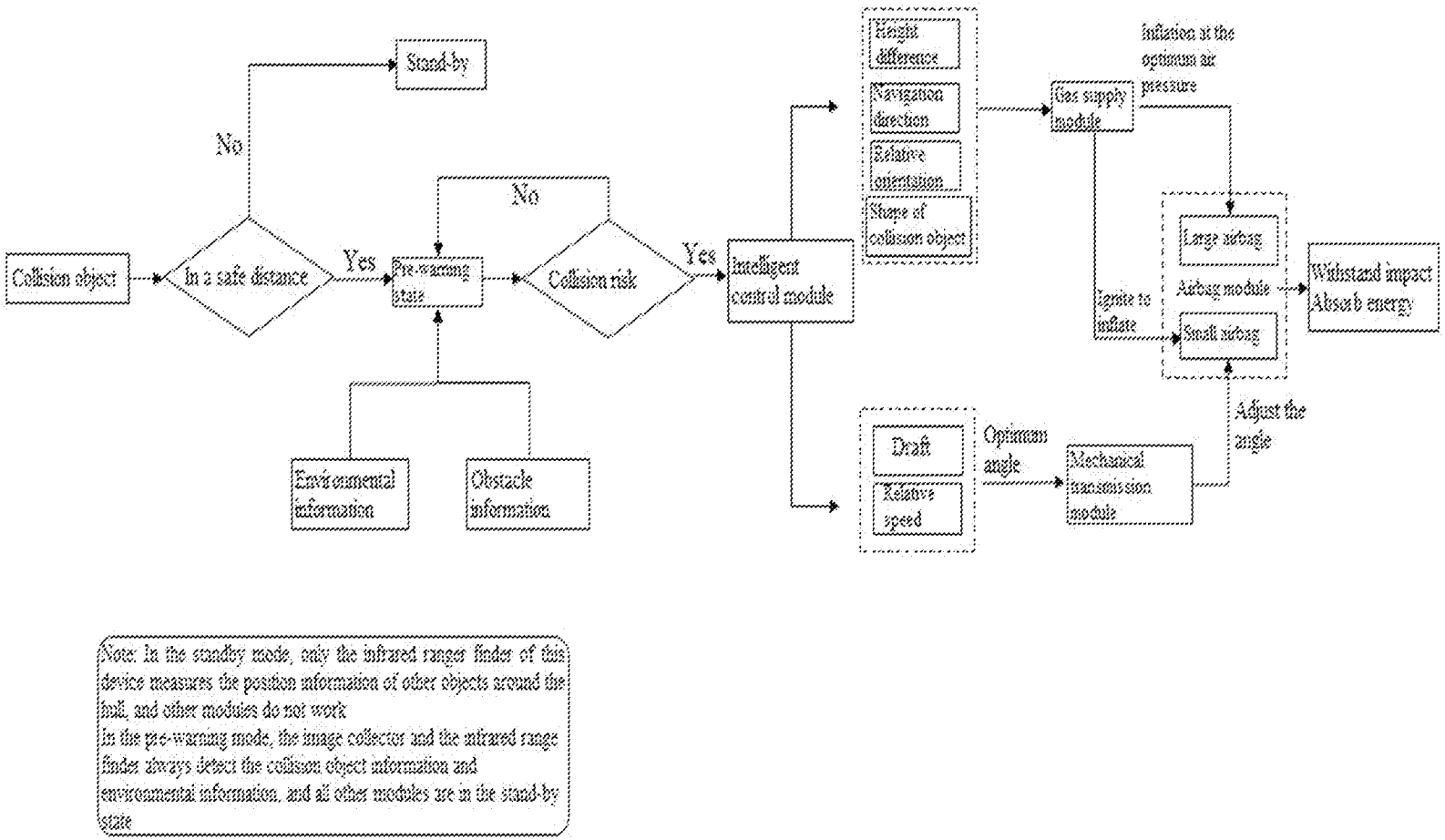
FIG. 12 is a flow chart of a working principle of the device.

Working principle: as shown in FIG. 12, the back of the housing 24 is connected with the slats through hinges 9, the side of each module of the housing 24 is provided with a connecting hole 13, the length of the telescopic connecting rod 25 is first adjusted according to the needs of the ship broadside protection area, and then each module of the housing 24 is connected by means of a telescopic connecting rod 25; the two ends of the telescopic connecting rod 25 are fixed in the connecting hole 13, and finally fixed on the broadside of the ship by means of a strong magnetic stripe 8;

the information of the collision object such as the navigation direction, relative orientation, height difference, draft, relative speed, surface shape, etc. is acquired and processed by the intelligent control assembly through sensors such as image acquisition sensors and infrared range finders 1, to predict the position of contact between the protection area and the collision object, that is, the curvature of the contact surface of the collision object; the value range of energy that the collision object brings to the ship is predicted and calculated; the intelligent control assembly converts such information into an optimum internal pressure of the large airbag 10 and an optimum collision angle of the internal small airbag 11;

the intelligent control assembly sends a gas supply instruction to the composite gas supply assembly, when the electric airtight valve 22 in the composite gas supply assembly is opened, the high-pressure gas in the high-pressure steel cylinder 3 is released to rapidly inflate the external spherical large airbag 10, and when the internal pressure of the airbag reaches the optimum pressure, the electric airtight valve 22 is closed; simultaneously, the gas generator 4 ignites to inflate the inner drop-like airbag 11.

after the inflation is completed, the intelligent control assembly sends an instruction to the mechanical transmission assembly; the rotation of the small motor 17 drives the gear A 19 to rotate, and the gear A 19 meshes with the transmission rack A 18*a*, so that the transmission rack A 18*a* moves up; since the transmission rack A 18*a* meshes with the gear B 7, it drives the gear B 7 to rotate, and at the same time, the gear B 7 meshes with the transmission rack B 18*b*, so that the transmission rack B 18*b* moves to the right; because the gear C 20 and the gear D 21 both mesh with the transmission rack B 18*b*, the gear C 20 and the gear D 21 rotate; because the small air outlet A 6*a* is fixedly connected to gear C 20, and the small air outlet A 6*b* is fixedly connected to gear D 21, resulting in that the small air outlet A 6*a* and the small air outlet B 6*b* are deflected, so that the rotation angle of the small airbag 11 changes, the two small airbags are adjusted to an optimum angle, and the brake is locked; similarly, when the motor reverses, the small airbag 11 rotates in the opposite direction; after the angle is adjusted, the inflated composite airbag fully absorbs the energy generated by the collision, to protect the collision area of the ship.

The above embodiments are only intended to illustrate the technical concept and characteristics of the present invention, and the purpose is to enable those skilled in the art to understand and implement the content of the present invention, and is not intended to limit the protection scope of the present invention. All equivalent changes or modifications made according to the spirit of the present invention shall fall within the protection scope of the present invention.

What is claimed is:

1. A marine modular intelligent anti-collision device based on airbags, which is applied to a field of ships, wherein a plurality of modules are arranged on a broadside of a ship, each module comprises a housing (24), and the housing (24) is provided with a composite gas supply assembly, a composite airbag assembly, an intelligent control assembly, and a mechanical transmission assembly; the composite airbag assembly comprises a large airbag (10) and small airbags (11); the composite gas supply assembly supplies gas for the composite airbag assembly; the composite airbag assembly is configured to resist an external collision of a hull and protect a structure of the hull; the mechanical transmission assembly is configured to adjust a collision angle of the small airbag (11); and the intelligent control assembly is configured for predicting an impact energy and a collision angle of a collision object, sending an inflation instruction to the composite gas supply assembly, inflating the large airbag (10) to a proper air pressure, inflating the small airbag (11) to a rated air pressure, and sending an angle adjustment instruction to the mechanical transmission assembly to adjust the collision angle of the small airbag (11).

2. The marine modular intelligent anti-collision device based on airbags according to claim 1, wherein the large airbag (10) is in a shape of a spheroid, and the surface of the large airbag (10) is provided with vent holes (12) arranged in an annular manner; the two small airbags (11) are located in the large airbag (10); and the small airbags (11) are in a shape of water droplets.

3. The marine modular intelligent anti-collision device based on airbags according to claim 2, wherein the composite gas supply assembly is located above one side of the housing (24); the composite gas supply assembly comprises a high-pressure steel cylinder (3), a gas transmission channel A (15*a*), a gas transmission channel B (15*b*), a gas generator (4), and an electric airtight valve (22); the gas generator (4) and the electric airtight valve (22) are all electrically connected with the intelligent control assembly; the high-pressure steel cylinder (3) is connected with the electric airtight valve (22); the electric airtight valve (22) is connected with the large airbag (10) through the gas transmission channel A (15*a*); and the gas generator (4) is connected with the small airbag (11) through the gas transmission channel B (15*b*).

4. The marine modular intelligent anti-collision device based on airbags according to claim 2, wherein a circular support frame (27) is arranged at a point near the air inlet of the large airbag (11), to stretch the large airbag (11) so as to arrange the small airbag (9) inside it; the outer periphery of the large airbag (11) is respectively provided with light bars (16) that are connected with the housing (24); and the housing (24) is provided with a storage bin (14), and the airbag (11) not inflated is folded in the storage bin (14).

5. The marine modular intelligent anti-collision device based on airbags according to claim 2, wherein the intelligent control assembly is located below one side of the housing (24); the intelligent control assembly comprises an image acquisition sensor, an infrared range finder (1), a central processing unit (2), and a plurality of wires; the wires are respectively electrically connected to the composite gas supply assembly and the mechanical transmission assembly; the image acquisition sensor is configured to collect and identify potential collision objects in surrounding areas and sea conditions near waters where the ship is located; the infrared range finder (1) assists the image acquisition sensor to send an environmental information and obstacle information to the central processing unit (2), then the central processing unit (2) preliminarily calculates a probability of any collision risk, and when the collision risk is confirmed, the central processing unit calculates an energy impact that the protection area is about to suffer, as well as the contact surface shape and collision angle of the collision object that the area is about to approach; the predicted impact energy is converted into an appropriate air pressure for the large airbag (10), and the collision contact surface shape and the collision angle are converted into the collision angle of the small airbag (11).

6. The marine modular intelligent anti-collision device based on airbags according to claim 2, wherein the housing (24) is provided with a base (23); the base (23) is provided with a small air outlet A (6*a*), a small air outlet B (6*b*), and a large air outlet (5), where the small air outlet A (6*a*) and the small air outlet B (6*b*) are rotatably connected with the housing (24); the large air outlet (5) is located between the small air outlet A (6*a*) and the small air outlet B (6*b*); the large airbag (10) is connected to the composite gas supply assembly through the large air outlet (5), and the small airbags (11) are respectively connected with the composite gas supply assembly through the small air outlet A (6*a*) and the small air outlet B (6*b*).

7. The marine modular intelligent anti-collision device based on airbags according to claim 6, wherein the mechanical transmission assembly comprises a small motor (17), a gear A (19), a gear B (7), a gear C (20), a gear D (21), a transmission rack A (18*a*), and a transmission rack B (18*b*);

the transmission rack A (18*a*) is vertically and slidably arranged in the housing (24) and is capable to move up and down, and the transmission rack B (18*b*) is horizontally and slidably arranged in the housing (24) and is capable to move horizontally; the transmission rack A (18*a*) and the transmission rack B (18*b*) are rotatably connected through the gear B (7);

the small motor (17) and the gear A (19) are rotatably connected, the gear A (19) and the gear B (7) mesh with the transmission rack A (18*a*) respectively, and the gear B (7), the gear C (20), and the gear D (21) mesh with the transmission rack B (18*b*) respectively;

the gear A (19), the gear B (7), the gear C (20), and the gear D (21) all are rotatably connected with the housing (24); and the gear C (20) is connected with the small air outlet A (6*a*), and the gear D (21) is connected with the small air outlet B (6*b*).

8. The marine modular intelligent anti-collision device based on airbags according to claim 7, wherein one side of the transmission rack A (18*a*) close to the broadside of the ship is provided with a plurality of roll balls A (26*a*) along its length direction, the housing (24) is provided with a vertical chute, and the transmission rack A (18*a*) is slidably arranged in the vertical chute through the plurality of roll balls A (26*a*); one side of the transmission rack B (18*b*) close to the broadside of the ship is provided with a plurality of roll balls B (26*b*) along its length direction, the housing (24) is provided with a transverse chute, and the transmission rack B (18*b*) is slidably arranged in the transverse chute through the plurality of roll balls B (26*b*).

9. The marine modular intelligent anti-collision device based on airbags according to claim 8, wherein the gear A (19), the gear B (7), the gear C (20), and the gear D (21) are connected to the housing (24) through a rotating structure, the rotating structure includes a rotating shaft and a bearing, where the outer ring of the bearing is connected to the inner ring of the gear, one end of the rotating shaft is arranged in the inner ring of the bearing, the other end of the rotating shaft is connected to the housing (24), and a rotational connection between the gear and the housing is realized through the connection between the bearing and the rotating shaft.

10. The marine modular intelligent anti-collision device based on airbags according to claim 1, wherein the composite gas supply assembly is located above one side of the housing (24); the composite gas supply assembly comprises a high-pressure steel cylinder (3), a gas transmission channel A (15*a*), a gas transmission channel B (15*b*), a gas generator (4), and an electric airtight valve (22); the gas generator (4) and the electric airtight valve (22) are all electrically connected with the intelligent control assembly; the high-pressure steel cylinder (3) is connected with the electric airtight valve (22); the electric airtight valve (22) is connected with the large airbag (10) through the gas transmission channel A (15*a*); and the gas generator (4) is connected with the small airbag (11) through the gas transmission channel B (15*b*).

11. The marine modular intelligent anti-collision device based on airbags according to claim 1, wherein a circular support frame (27) is arranged at a point near the air inlet of the large airbag (11), to stretch the large airbag (11) so as to arrange the small airbag (9) inside it; an outer periphery of the large airbag (11) is respectively provided with light bars (16) that are connected with the housing (24); and the housing (24) is provided with a storage bin (14), and the airbag (11) not inflated is folded in the storage bin (14).

12. The marine modular intelligent anti-collision device based on airbags according to claim 1, wherein the intelligent control assembly is located below one side of the housing (24); the intelligent control assembly comprises an image acquisition sensor, an infrared range finder (1), a central processing unit (2), and a plurality of wires; the wires are respectively electrically connected to the composite gas supply assembly and the mechanical transmission assembly; the image acquisition sensor is configured to collect and identify potential collision objects in surrounding areas and sea conditions near waters where the ship is located; the infrared range finder (1) assists the image acquisition sensor to send an environmental information and obstacle information to the central processing unit (2), then the central processing unit (2) preliminarily calculates a probability of any collision risk, and when the collision risk is confirmed, the central processing unit calculates an energy impact that the protection area is about to suffer, as well as the contact surface shape and collision angle of the collision object that the area is about to approach; the predicted impact energy is converted into an appropriate air pressure for the large airbag (10), and the collision contact surface shape and the collision angle are converted into the collision angle of the small airbag (11).

13. The marine modular intelligent anti-collision device based on airbags according to claim 1, wherein the housing (24) is provided with a base (23); the base (23) is provided with a small air outlet A (6*a*), a small air outlet B (6*b*), and a large air outlet (5), where the small air outlet A (6*a*) and the small air outlet B (6*b*) are rotatably connected with the housing (24); the large air outlet (5) is located between the small air outlet A (6*a*) and the small air outlet B (6*b*); the large airbag (10) is connected to the composite gas supply assembly through the large air outlet (5), and the small airbags (11) are respectively connected with the composite gas supply assembly through the small air outlet A (6*a*) and the small air outlet B (6*b*).

14. The marine modular intelligent anti-collision device based on airbags according to claim 13, wherein the mechanical transmission assembly comprises a small motor (17), a gear A (19), a gear B (7), a gear C (20), a gear D (21), a transmission rack A (18*a*), and a transmission rack B (18*b*);

the transmission rack A (18*a*) is vertically and slidably arranged in the housing (24) and is capable to move up and down, and the transmission rack B (18*b*) is horizontally and slidably arranged in the housing (24) and is capable to move horizontally; the transmission rack A (18*a*) and the transmission rack B (18*b*) are rotatably connected through the gear B (7);

the small motor (17) and the gear A (19) are rotatably connected, the gear A (19) and the gear B (7) mesh with the transmission rack A (18*a*) respectively, and the gear B (7), the gear C (20), and the gear D (21) mesh with the transmission rack B (18*b*) respectively;

the gear A (19), the gear B (7), the gear C (20), and the gear D (21) all are rotatably connected with the housing (24); and the gear C (20) is connected with the small air outlet A (6*a*), and the gear D (21) is connected with the small air outlet B (6*b*).

15. The marine modular intelligent anti-collision device based on airbags according to claim 14, wherein one side of the transmission rack A (18*a*) close to the broadside of the ship is provided with a plurality of roll balls A (26*a*) along its length direction, the housing (24) is provided with a vertical chute, and the transmission rack A (18*a*) is slidably arranged in the vertical chute through the plurality of roll balls A (26*a*); one side of the transmission rack B (18*b*) close to the broadside of the ship is provided with a plurality of roll balls B (26*b*) along its length direction, the housing (24) is provided with a transverse chute, and the transmission rack B (18*b*) is slidably arranged in the transverse chute through the plurality of roll balls B (26*b*).

16. The marine modular intelligent anti-collision device based on airbags according to claim 14, wherein the gear A (19), the gear B (7), the gear C (20), and the gear D (21) are connected to the housing (24) through a rotating structure, the rotating structure includes a rotating shaft and a bearing, where the outer ring of the bearing is connected to the inner ring of the gear, one end of the rotating shaft is arranged in the inner ring of the bearing, the other end of the rotating shaft is connected to the housing (24), and a rotational connection between the gear and the housing is realized through the connection between the bearing and the rotating shaft.

17. The marine modular intelligent anti-collision device based on airbags according to claim 1, wherein one side of the housing (24) close to the broadside of the ship is provided with a plurality of slats, one side of the slats close to the broadside of the ship is provided with strong magnetic stripes (8), each of the slats is connected by means of a hinge (9), and the housing (24) is installed on the broadside of the ship by means of the strong magnetic stripes (8); a telescopic connecting rod (25) is arranged between every two modules of the housing (24).

* * * * *